US006883795B2

(12) United States Patent
McCormick et al.

(10) Patent No.: US 6,883,795 B2
(45) Date of Patent: Apr. 26, 2005

(54) ELECTRIC CLAMP

(75) Inventors: Peter E. McCormick, Dallas, TX (US); Daniel Alan Beall, Allen, TX (US)

(73) Assignee: Delaware Capital Formation, Inc., Wilmington, DE (US)

( * ) Notice: Subject to any disclaimer, the term of this patent is extended or adjusted under 35 U.S.C. 154(b) by 16 days.

(21) Appl. No.: 10/640,200

(22) Filed: Aug. 13, 2003

(65) Prior Publication Data

US 2004/0061270 A1 Apr. 1, 2004

Related U.S. Application Data

(63) Continuation of application No. 10/321,880, filed on Dec. 17, 2002, now Pat. No. 6,644,638, which is a continuation-in-part of application No. 09/887,293, filed on Jun. 22, 2001, now Pat. No. 6,585,246.

(51) Int. Cl.[7] ..... B25B 1/04; B25B 5/04

(52) U.S. Cl. ..... 269/239; 269/225; 269/32

(58) Field of Search ..... 269/225, 32, 228, 269/201, 3, 6, 237–239, 243, 24, 27

(56) References Cited

U.S. PATENT DOCUMENTS

| | | | |
|---|---|---|---|
| 3,599,957 A | | 8/1971 | Blatt |
| 4,458,889 A | | 7/1984 | McPherson et al. |
| 4,637,597 A | | 1/1987 | McPherson et al. |
| 4,723,767 A | | 2/1988 | McPherson et al. |
| 4,770,401 A | | 9/1988 | Donaldson |
| 4,793,602 A | | 12/1988 | McPherson |
| 4,854,564 A | | 8/1989 | McPherson et al. |
| 4,904,909 A | | 2/1990 | Zeeland et al. |
| 5,165,670 A | | 11/1992 | Sawdon |
| 5,912,541 A | | 6/1999 | Bigler et al. |
| 5,996,984 A | | 12/1999 | Takahashi |
| 6,220,588 B1 | | 4/2001 | Tunkers |
| 6,354,580 B1 | | 3/2002 | Nagai et al. |
| 6,644,638 B1 | * | 11/2003 | McCormick ..... 269/225 |

* cited by examiner

*Primary Examiner*—Lee D. Wilson
(74) *Attorney, Agent, or Firm*—Brian F. Russell; Dillon & Yudell LLP

(57) ABSTRACT

An electrically powered clamp has a housing, a motor attached to the housing, a ball screw driven by the motor via a belt, and a linkage driven at one end by the ball screw such that the linkage rotates an output shaft attached to the other end of the linkage. The motor and belt drive the ball screw between a fully extended position to rotate the shaft to a clamped position, and a fully retracted position to rotate the shaft to an unclamped position. A built-in computer monitors and controls the clamp. The clamp can also be controlled and monitored by a remote pendant. Indicator lights on the housing and remote pendant convey clamp status information. The clamp is programmable and can memorize the clamped and unclamped positions. The clamp uses velocity and position feedback to determine appropriate drive mode. Torque monitors and timers determine if the clamp becomes stuck.

41 Claims, 7 Drawing Sheets

Fig. 8
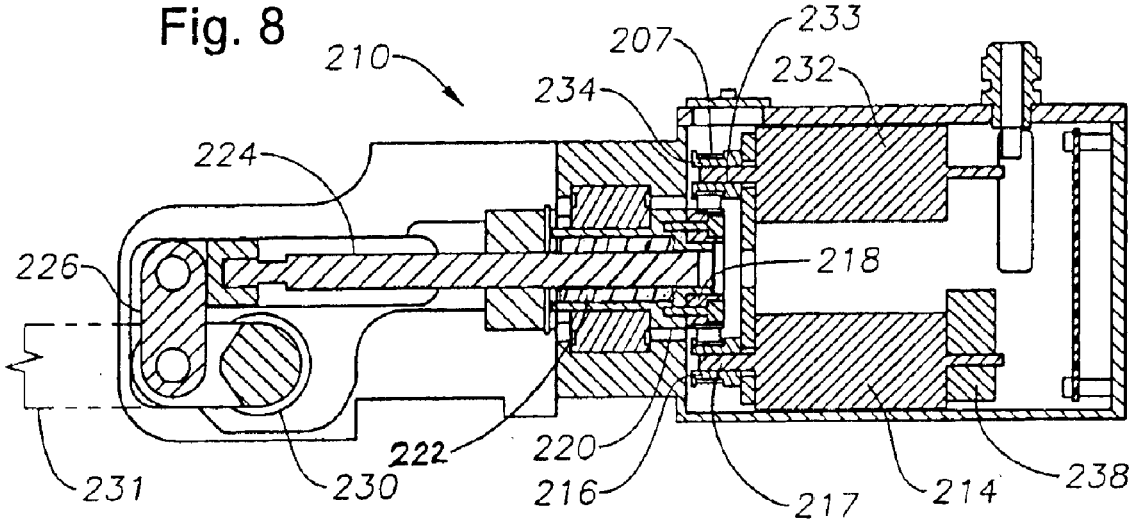
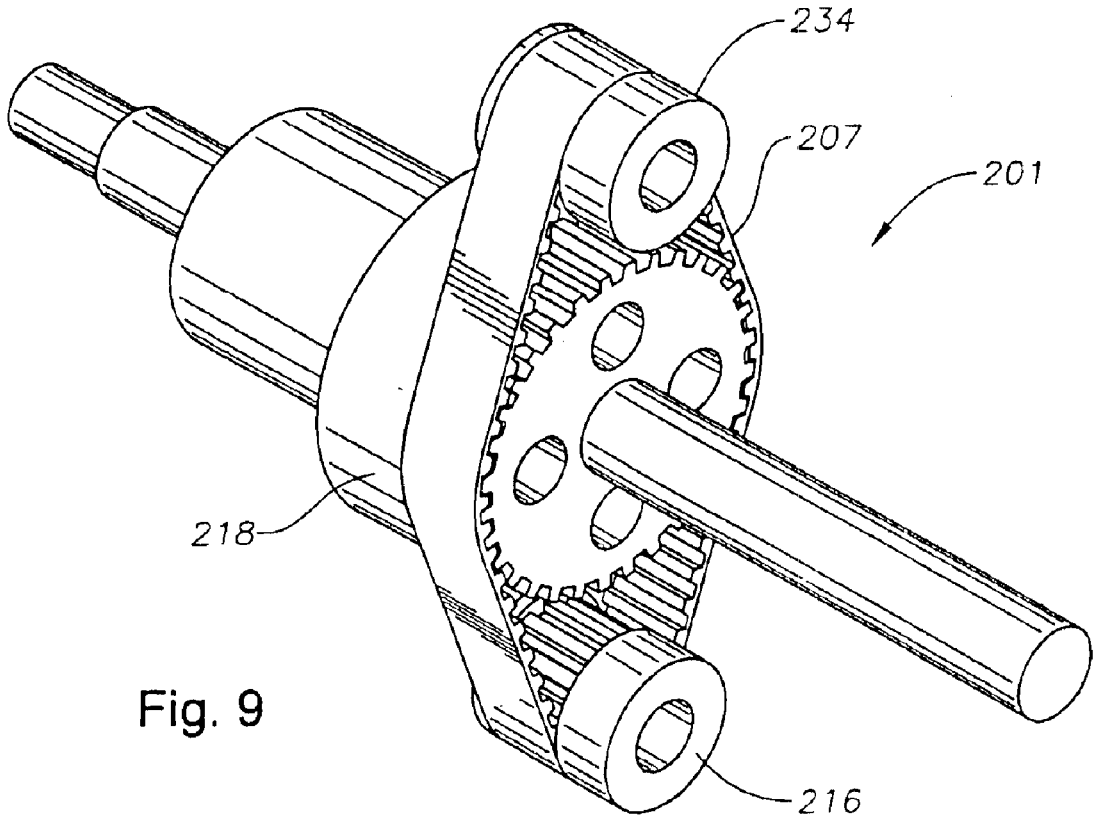
Fig. 9

ELECTRIC CLAMP

The present application is a continuation of U.S. patent application Ser. No. 10/321,880, filed on Dec. 17, 2002 now U.S. Pat. No. 6,644,638 which is a continuation-in-part of U.S. patent application Ser. No. 09/887,293, filed on Jun. 22, 2001 now U.S. Pat. No. 6,585,246. All of the foregoing applications are incorporated by reference in their entireties.

BACKGROUND OF THE INVENTION

1. Technical Field

This invention pertains to power clamps and more particularly to clamps driven by electric motors. Clamps are used to secure an object to aid assembly or to secure it during transport from one location to another.

2. Description of the Related Art

The robotics and automation industry heavily relies on power clamps for securing objects such as mechanical or electrical components so those components can be integrated into an assembly or moved from one assembly station to another. Clamps of various sizes, shapes, and configurations have been used to secure objects ranging in size from as small as electronic circuit boards to as large as entire automobile body panels. Clamps can be comprised of opposing members, but are more commonly mounted to a work surface and use one arm to pin the object against the work surface.

The majority of clamps currently used in the automation industry are pneumatically powered. This is primarily due to the significantly greater power obtainable from a pneumatically powered clamp compared to existing electrical clamps of similar size. Disadvantages of prior versions of electric clamps include being large, complex, delicate, or expensive.

SUMMARY OF THE INVENTION

The present invention uses an innovative design to produce an electric clamp with high clamping power in a small and relatively inexpensive package. In one embodiment, the clamp of the present invention comprises an electrically powered clamp having a housing, a motor attached to the housing, a ball screw driven by the motor via a belt, and a linkage driven at one end by the ball screw such that the linkage rotates an output shaft attached to the other end of the linkage. The motor and belt drive the ball screw between a fully extended position to rotate the output shaft to a clamped position, and a fully retracted position to rotate the output shaft to an unclamped position. A built-in controller monitors and controls the clamp. The clamp can also be controlled and monitored by a remote pendant. Indicator lights on the housing and remote pendant convey clamp status information. The clamp is programmable and can memorize the clamped and unclamped positions. The clamp uses velocity and position feedback to determine appropriate drive mode. Torque monitors and timers determine if the clamp becomes stuck.

BRIEF DESCRIPTION OF THE DRAWINGS

So that the manner in which the described features, advantages and objects of the invention, as well as others which will become apparent, are attained and can be understood in detail, more particular description of the invention briefly summarized above may be had by reference to the embodiments thereof that are illustrated in the drawings, which drawings form a part of this specification. It is to be noted, however, that the appended drawings illustrate only typical preferred embodiments of the invention and are therefore not to be considered limiting of its scope as the invention may admit to other equally effective embodiments.

FIG. 8 is a side view of an electric clamp constructed in accordance with a second embodiment of the present invention showing the clamp in its clamped position.

FIG. 9 is a partial isometric view of a drive system of the electric clamp of FIG. 8.

DETAILED DESCRIPTION OF THE PREFERRED EMBODIMENT

Figure 1:
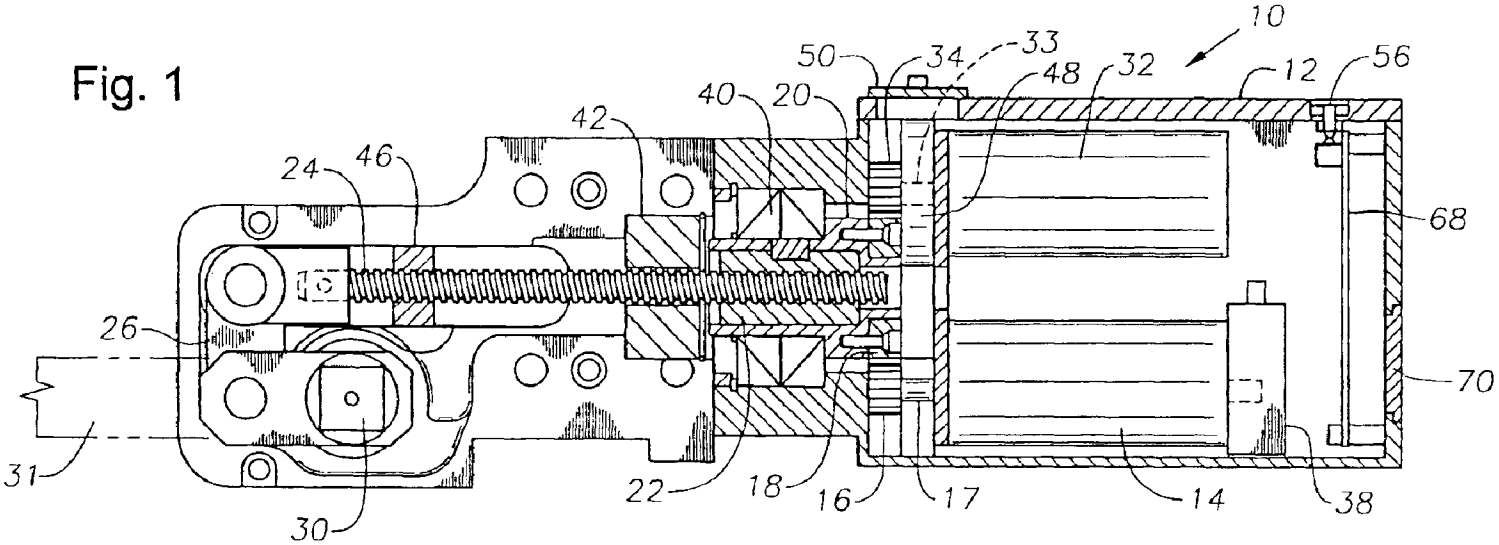
FIG. 1 is a side view of an electric clamp constructed in accordance with one embodiment of the present invention showing the clamp in its clamped position.
Figure 2:
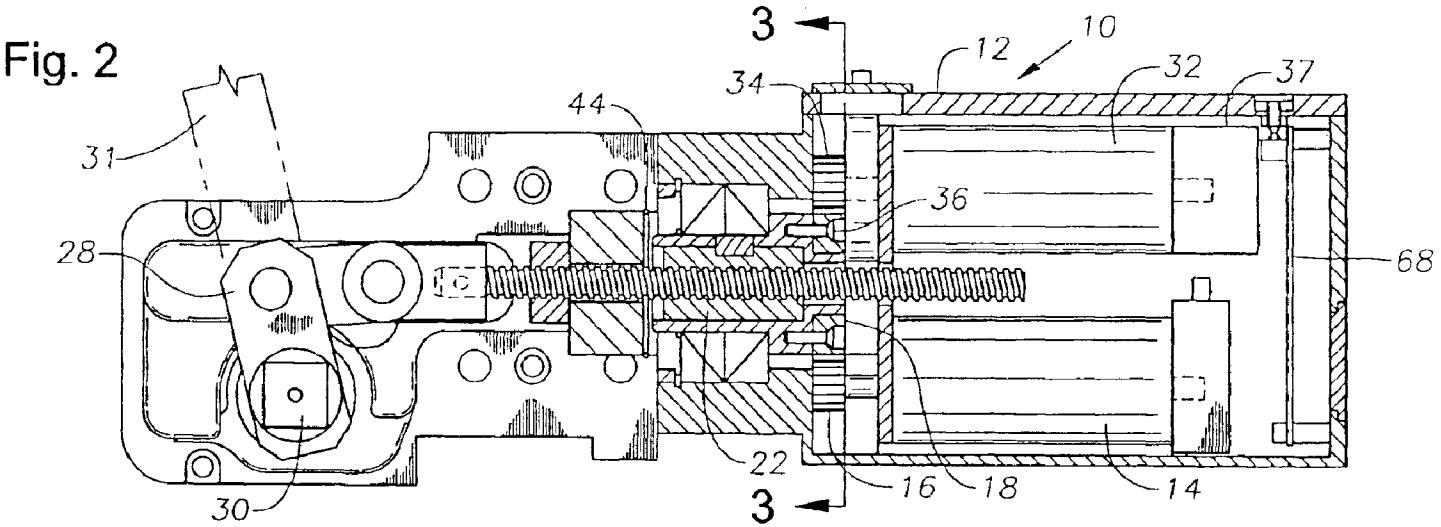
FIG. 2 is a side view of the clamp of FIG. 1, but showing the clamp in its unclamped position.

FIGS. 1 and 2 illustrate an electric clamp 10. Electric clamp 10 has a housing 12 that serves as a base on and inside of which other structural elements are mounted. Housing 12 protects the housed components. Housing 12 can be made of any durable, lightweight material, but is preferably metal or another conductive material that can be electrically grounded. It is desirable that housing 12 be easily formed into complex shapes to allow for space-efficient integration of various components.

Electric clamp 10 further comprises a motor 14. Motor 14 is a conventional electrically driven motor that mounts to housing 12 and serves to drive motor gear 16. The motor 14 can be virtually any type of electric motor. Different applications may dictate whether the motor is preferably an ac or dc motor, a stepper motor, an induction motor, a brushless motor, or other less common motor type. A dc motor offers the advantages of low cost and simple control requirements, but other requirements may dictate other motor types. Larger motors are generally required for larger clamps.

Figure 3:
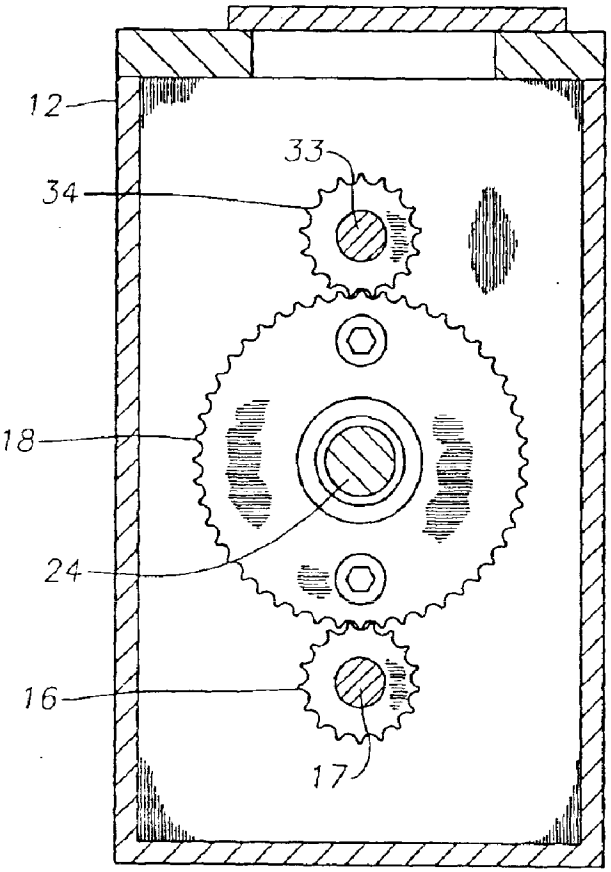
FIG. 3 is a section view along Section 3—3 of FIG. 2.

Motor gear 16 is on the output shaft 17 of motor 14 and engages ball nut gear 18 (FIG. 3). Ball nut gear 18 attaches to and drives ball nut hub 20 in response to motor gear 16. Hub 20 attaches to and drives ball nut 22. As ball nut 22 is rotated in place by hub 20, ball screw 24, a threaded shaft going through ball nut 22, advances or retreats depending on the direction of rotation of ball nut 22. The gear ratios for motor gear 16 and ball nut gear 18 can be chosen to produce a desired torque or rotational rate for ball nut 22. That determines the power or rate of advance/retreat of ball screw 24.

One end of ball screw 24 pivotally attaches to one end of link 26. The opposite end of link 26 pivotally attaches to an end of link 28. Clamp output shaft 30 is rigidly attached to the opposite end of link 28. Clamp arm 31 (shown in phantom line) is mounted to clamp output shaft 30. Clamp arms of various sizes can be attached, depending on a user's needs.

In the embodiment of FIG. 1, slave motor 32 is used to provide additional torque. Slave motor 32 is wired in parallel with motor 14 to assist motor 14. The same voltage is applied to both motors. Slave motor 32, through its output shaft 33, drives motor gear 34, which drives ball nut gear 18, each identical in operation to motor 14, output shaft 17, and motor gear 16, respectively.

In the basic operation of clamp 10 of FIG. 1, power is supplied to motors 14 and 32 to drive motor gears 16 and 34. Those gears drive ball nut gear 18, which drives hub 20. Hub 20 rotates ball nut 22. Ball nut 22 drives ball screw 24, which drives links 26 and 28, rotating clamp output shaft 30 to a fully clamped (FIG. 1) or fully released (FIG. 2) position, depending on the direction of rotation of ball nut 22.

FIG. 2 shows an optional brake 37 attached to the motor shaft 33 of slave motor 32 that can be used to stop slave motor 32, and therefore stop the motion of clamp 10. Brake 37 may be required if large clamp arms having high rotational inertia or significant weight are used. In those situations, the inertia or moment may cause clamp 10 to move toward the clamped or unclamped position even though no power is applied. Brake 37 prevents such drift.

While the structural elements described above are sufficient to describe the basic configuration and operation of clamp 10, there are many other elements that enhance its functionality. Encoder 38 mounts to motor 14. The encoder 38 shown in FIG. 1 attaches to motor shaft 17 of motor 14. Encoder 38 provides motor angle information for position feedback. The motor angle information tells how far motor 14 has rotated from the clamped or unclamped position, therefore determining the position of clamp arm 31. An absolute or incremental encoder can be used, or another type of motor position sensor, such as a resolver, can be used.

Ball nut 22 is supported by thrust bearing 40. Thrust bearing 40 mounts between housing 12 and ball nut 22 and carries the thrust load generated during the clamping process. Similarly, ball screw 24 is supported by support bearing 42. Bearing 42 mounts between housing 12 and ball screw 24 and prevents lateral loads from being transferred to ball screw 24 during extreme loading conditions. Bearing 42, in conjunction with retainer ring 44, also acts as a barrier to prevent grease from moving from links 26, 28 into the vicinity of ball nut 22.

Stop collar 46 is adjustably fixed to ball screw 24 and physically inhibits further retraction of ball screw 24 once stop collar 46 is pulled into contact with bearing 42. This feature is useful to prevent clamp 10 from opening too far. The need for restriction commonly arises when objects in the vicinity of clamp 10 interfere with the full range of motion of clamp 10, particularly when longer clamp arms are used.

Figure 4:
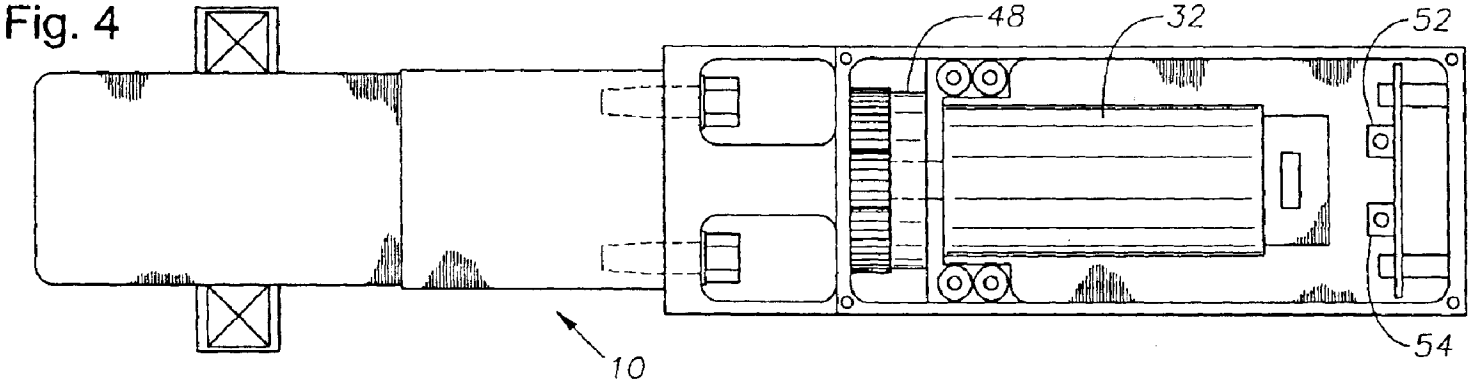
FIG. 4 is a top view of the clamp of FIG. 1 with cover removed.

FIG. 4 shows thumb wheel 48 attached to the motor shaft of slave motor 32. Wheel 48 allows clamp 10 to be moved without electrical power. This is useful when no power is available, such as during initial setup, or when the drive control electronics (described below) are unavailable. This can occur when clamp 10 becomes extremely stuck or the electronics themselves fail. Wheel 48 is normal concealed and protected by access cover 50, as shown in FIG. 5.

Figure 5:
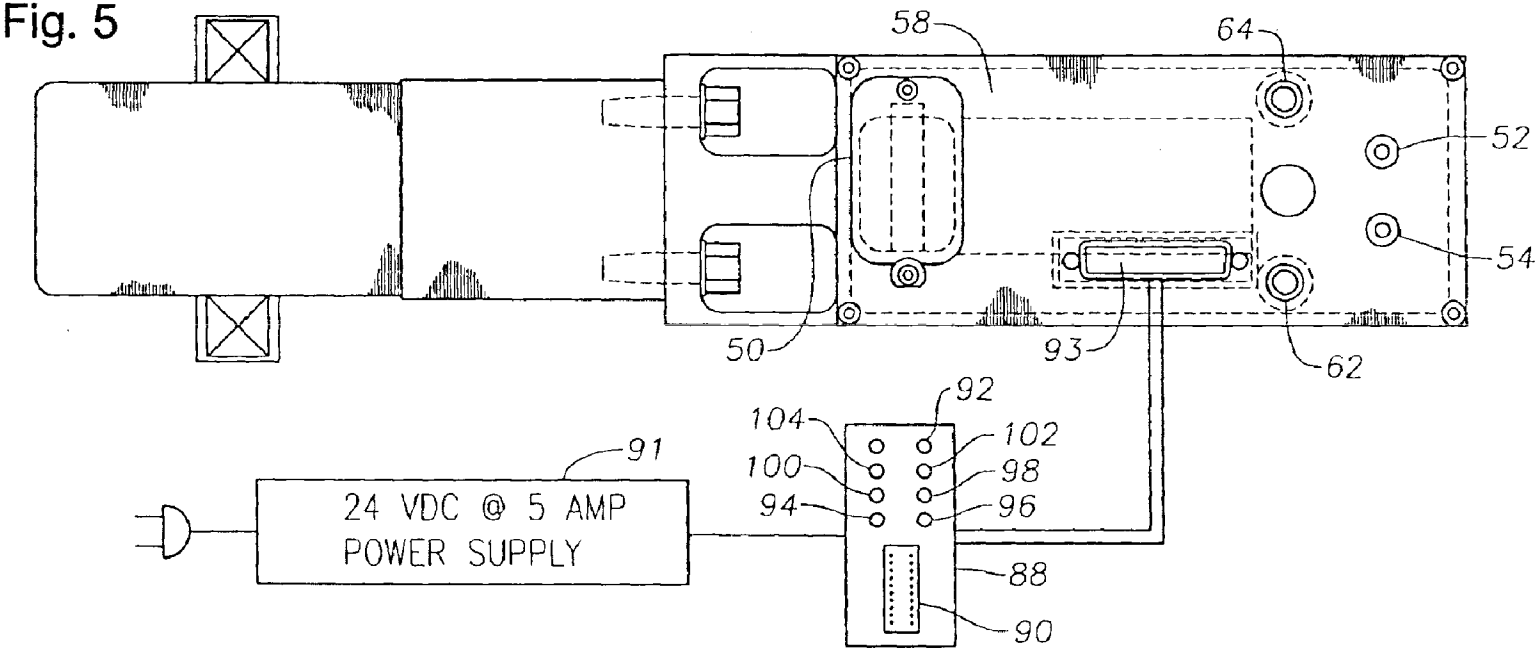
FIG. 5 is a top view of the clamp of FIG. 1 with cover on and remote pendant attached.

FIG. 5 also shows clamp buttons 52 and 54. Buttons 52, 54 allow a user to drive clamp 10 to a clamped or unclamped position, respectively. The motion produced is relatively slow in both directions and clamp 10 moves only while a button is depressed. Buttons 52, 54 are located in recesses 56 (FIG. 1) in cover plate 58. Recesses 56 are covered to prevent infiltration of contaminates and to prevent inadvertent engagement of buttons 52, 54. A pointed tool, such as a screwdriver, is needed to actuate buttons 52, 54.

Figure 6:
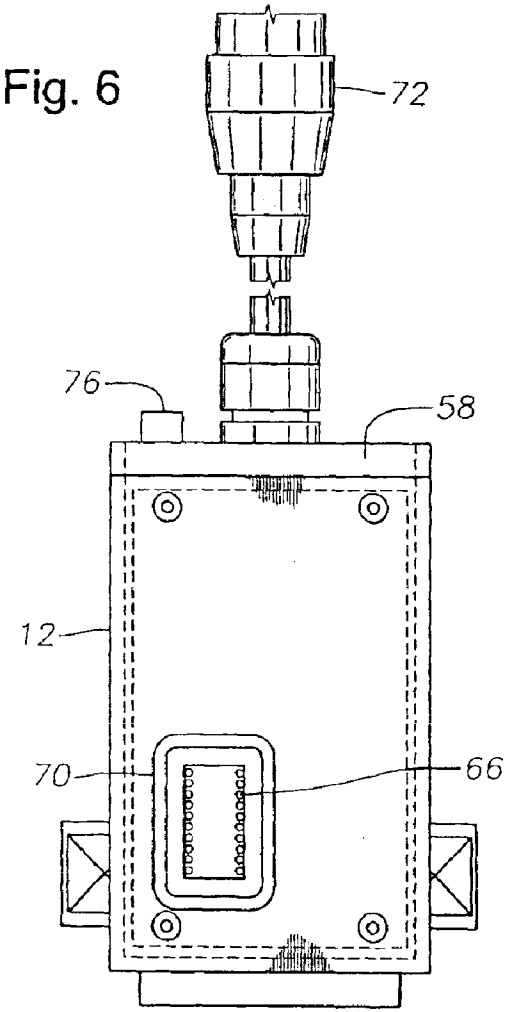
FIG. 6 is an end view of the clamp of FIG. 1.

Also located on cover plate 58 are status lights 62, 64. Clamped status light 62, when lit, indicates clamp 10 is very close to the programmed clamped position. (The programmable aspects are discussed below.) Similarly, unclamped status light 64 lights up when clamp 10 is very close to the programmed unclamped position. In addition, there are indicator lights 66 (FIG. 6) on control circuit board 68 (FIG. 2) within housing 12. Indicator lights 66 are viewed through window 70 (FIG. 1) and provide an operator information about the operational state of clamp 10.

Electrical power is primarily supplied to clamp 10 through control cable 72 (FIG. 6), which fastens to cover plate 58 and electrically connects a wire bundle to electronics within housing 12. Power could be dc, ac, 24 volts, or 48 volts—a preferred embodiment uses 24 volts dc. Higher voltages, such as 110 or 220 ac voltages, could be used, but are generally considered unacceptable because of safety concerns. Electrical power is typically provided by an external power supply with enough current capacity to service several clamps.

Other electrical signals, such as a command signal from the user or clamp status information, are also transmitted through control cable 72. The electronics within housing 12 include control circuit board 68 (FIG. 1). Control board 68 has the circuitry necessary to control clamp 10.

Figure 7:
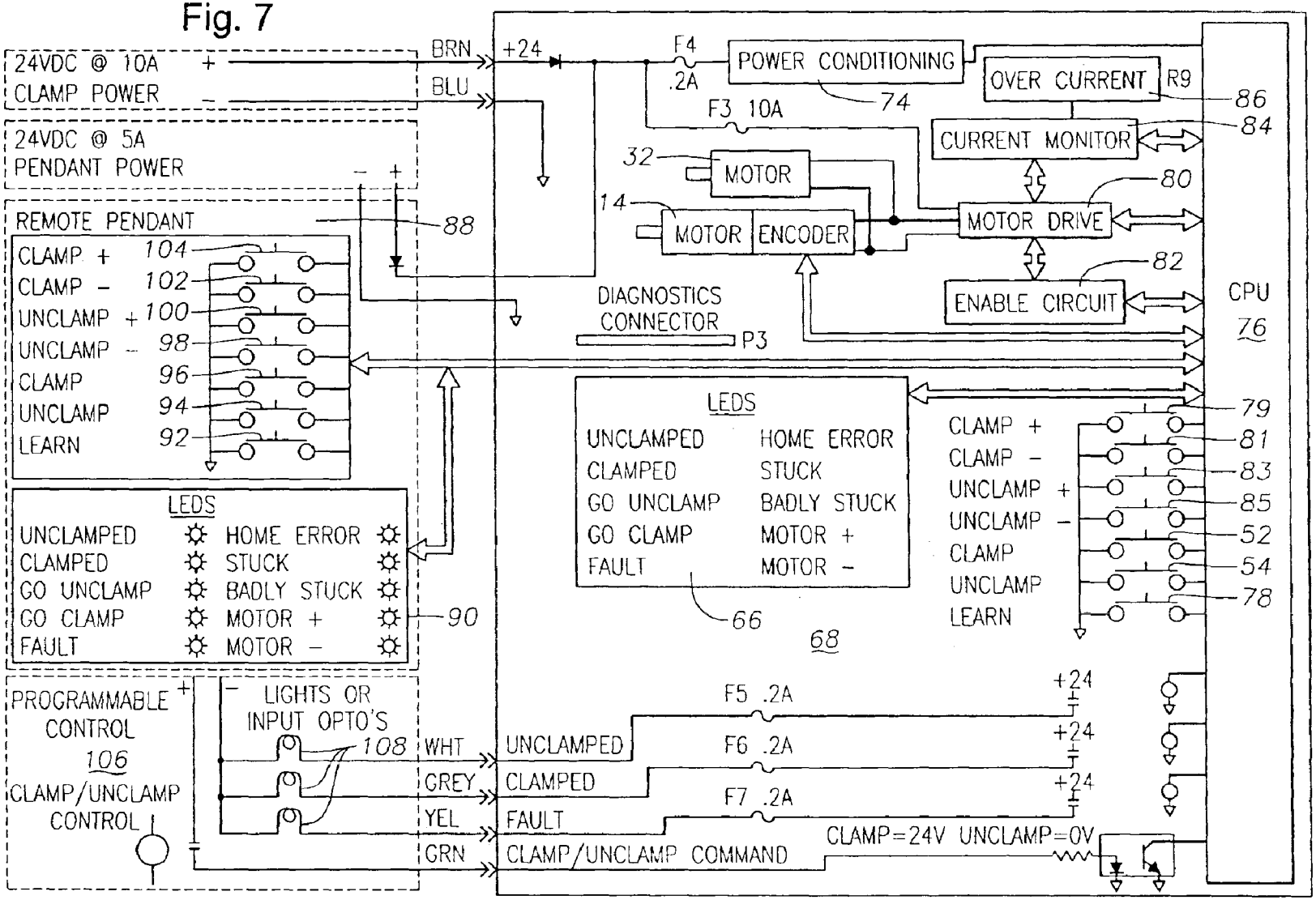
FIG. 7 is a schematic diagram of the electronics used in the clamp of FIG. 1.

FIG. 7 shows conceptually the electronic components comprising control board 68. Power conditioner 74 is used to provide clean 5 and 15 volts dc signal to control board 68. A CPU 76 mounted to control board 68 controls all aspects of the operation of clamp 10. CPU 76 comprises timers, counters, input and output portals, memory modules, and programmable instructions to regulate motion algorithms, error recovery, status messaging, test display, limit adjustment, and pushbutton control. Indicator lights 66 are connected to CPU 76.

Clamp 10 has pushbuttons 79, 81, 83, 85 on the exterior of housing 12 to permit a user to adjust the position to which CPU 76 will command the motor to move upon receiving a clamp or unclamp command. There is also a pushbutton 78 allowing CPU 76 to learn and memorize the clamped position based on when the motor stalls. This is usually a quicker way to set the programmed clamp position than by using pushbuttons 79, 81, 83, 85. All of those pushbuttons 78, 79, 81, 83, 85, as well as clamp/unclamp buttons 52, 54, are illustrated in FIG. 7.

CPU 76 controls motor drive circuit 80 and enabling circuit 82. Those circuits 80, 82 supply the drive current sent to slave motor 32 and motor 14. Because motor drive circuit 80 is easily damaged by logically inconsistent electrical input, enabling circuit 82 is used to independently assure logically consistent input. If excess current is detected by current monitor 84, such as may occur if clamp 10 is stalled or stuck, the output from motor drive circuit 80 is inhibited. A user may set an over-current threshold using over-current circuit 86.

All user interfaces described above are also found on remote pendant 88 (FIG. 5). Thus, remote pendant 88 allows a user to operate clamp 10 some short distance from clamp 10. This can be useful if clamp 10 is placed deeply within an automation tool, making the interfaces on housing 12 inaccessible. Lights 90 equivalent to indicator lights 66 are found on remote pendant 88, so clamp status information can be observed. Remote pendant power supply 91 (FIG. 5) provides electrical power to clamp 10 through remote pendant 88 via connector 93 on cover plate 58. This is useful if conventional power is unavailable, as is often the case in the early stages of building an automation system. Pushbuttons 92, 94, 96, 98, 100, 102, and 104, provide the same functionality as pushbuttons 78, 54, 52, 85, 83, 81, and 79, respectively, using remote pendant 88.

Clamps used in the automation industry are commonly used in conjunction with hundreds of other clamps, each clamp performing a specific function in a carefully choreographed manner. Often the multitude of clamps is controlled by a central controller issuing commands to the various clamps at the proper time. Clamp 10 accepts such external control commands through interface 106 (FIG. 7). Clamp 10 is typically isolated from the external controller using optical isolators 108, however simple lights or light emitting diodes (LEDs) may also be used. The lights or LEDs can convey essential status information such as clamped, unclamped, or a fault condition. This information can be passed to the central controller as well.

Referring now to FIG. 8, an alternate embodiment of the present invention is depicted as clamp 210. Like the preceding embodiment, the components of clamp 210 are located entirely within its housing 212, other than the clamp arm 231 and the remote pendant (not shown). The primary difference between clamp 210 and clamp 10 of FIGS. 1 and 2 is the belt drive assembly 201 (FIG. 9) utilized by clamp 210. Thus, clamp 210 is very similar to clamp 10, but in this embodiment of the present invention, the direct gear-to-gear drive assembly of clamp 10 illustrated in FIGS. 1-3 is replaced by the belt drive assembly 201. The belt drive assembly 201 uses at least one drive sprocket (two are shown: 216, 234), a drive belt 207, and a center sprocket 218. The sprockets 216, 234, and 218 have external teeth that engage internal grooves on the drive belt 207. The drive sprockets 216, 234 engage and drive the belt 207 which, in turn, drives the center sprocket 218. The sprockets 216, 234 are mounted to drive shafts 217, 233, which extend from motors 214, 232, respectively. These components are similar or identical to the drive shafts 17, 33 and motors 14, 32, described above for the previous embodiment.

To maintain adequate separation, sprockets 216, 234 are sufficiently spaced apart in a radial direction (relative to their axes of rotation) so as to not make direct contact with the center sprocket 218 that is located between sprockets 216, 234. Center sprocket 218 is mounted to and drives a ball nut hub 220 having internal threads. As ball nut hub 220 is rotated by center sprocket 218, a ball screw 224 advances or retreats depending on the direction of rotation of ball nut 222. Ball screw 224 is a threaded shaft going through ball nut hub 220, and is otherwise identical in function to ball screw 24 as described above. The tooth ratios for sprockets 216, 234, 218, and belt 207 are selected to produce a desired torque or rotational rate for ball nut hub 220, which determines the power or rate of advance/retreat of ball screw 224. Other than the components employed and operated by belt drive assembly 201, clamp 210 utilizes the same elements and operates in an identical manner as the previously described embodiment including, for example, a sensor or encoder 238 on motor 214. The ball screw 224 is coupled to a linkage 226 to manipulate an output shaft 230 and a clamp arm 231.

Figure 10:
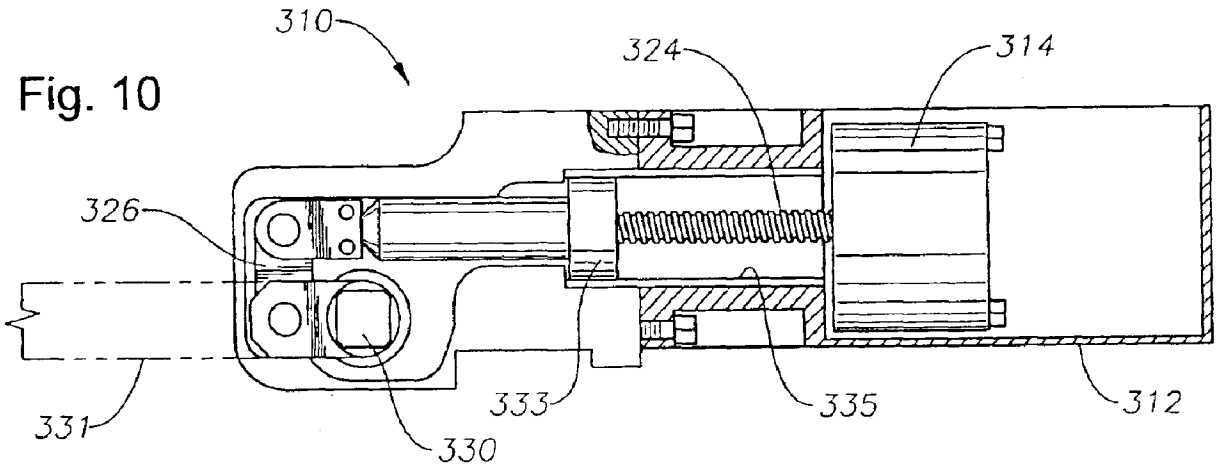
FIG. 10 is a side view of an electric clamp constructed in accordance with a third embodiment of the present invention showing the clamp in its clamped position.
Figure 11:
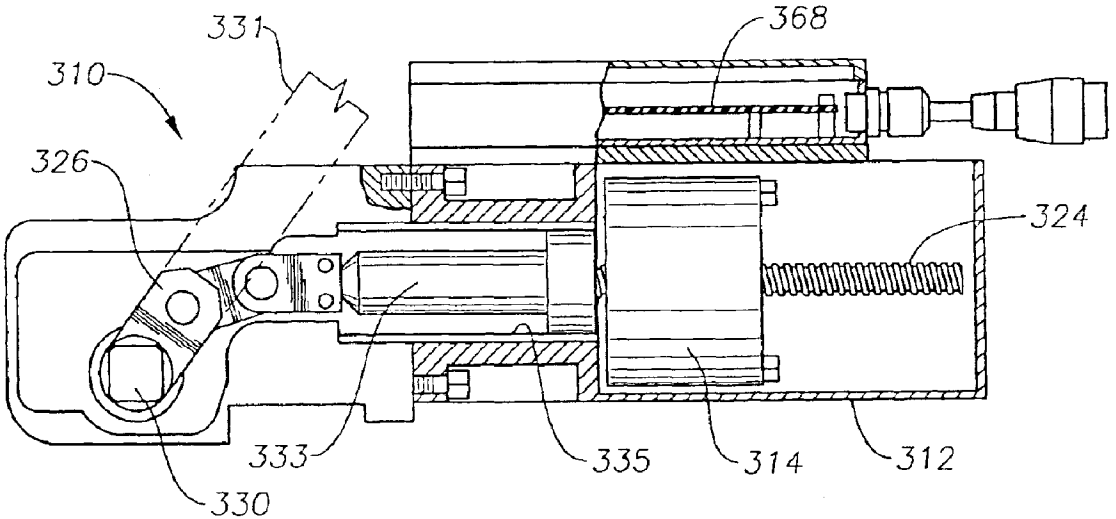
FIG. 11 is a side view of the clamp of FIG. 10, but showing the clamp in its unclamped position.

Referring now to FIGS. 10 and 11, a third embodiment of the present invention is depicted as an electric clamp 310. Electric clamp 310 has a housing 312 and a number of other components including a lead screw 324, which are all entirely enclosed within housing 312. Clamp 310 is similar to the preceding embodiments in many respects, but differs primarily in the manner in which it manipulates the output shaft 330 and clamp arm 331. In particular, clamp 310 uses a single electric motor 314, which is preferably a linear actuator, to advance and retreat a lead screw 324 extending axially through the motor 314. Consequently, no separate ball nut hub or ball nut are required.

The lead screw 324 is further coupled to the output shaft 330 through components such as a linkage 326 and a piston 333. The piston 333 is mounted in a chamber 335 that is located within the housing 312. In this disclosure, the terms piston and chamber are not necessarily used in the conventional sense to include a sealing relationship. Rather, these terms are used to denote the relative motion of the components, i.e., substantial restriction of radial motion of the piston by the chamber, while allowing the piston to move axially within the chamber. In the version shown, motor 314, lead screw 324, and piston 333 are coaxial. The piston 333 is coupled to the lead screw 324 and the output shaft 330, such that axial movement of the lead screw 324 by the electric motor 314 moves the piston 333 axially within the chamber 335, and moves the output shaft 330 and the clamp arm 331 through a range of motion. The other components described above and used in conjunction with the previous embodiments are likewise available for use with and employed by clamp 310. In this version of the invention, the control circuit 368 of electric clamp 310 is located in an upper portion of the housing 312.

Figure 12:
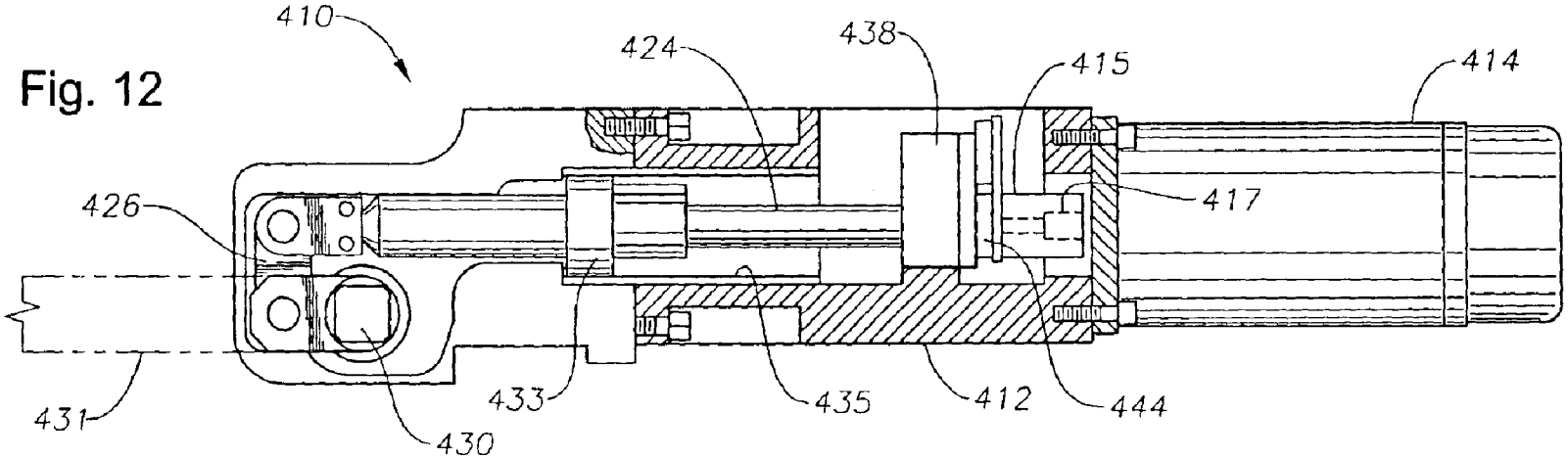
FIG. 12 is a side view of an electric clamp constructed in accordance with a fourth embodiment of the present invention showing the clamp in its clamped position.
Figure 13:
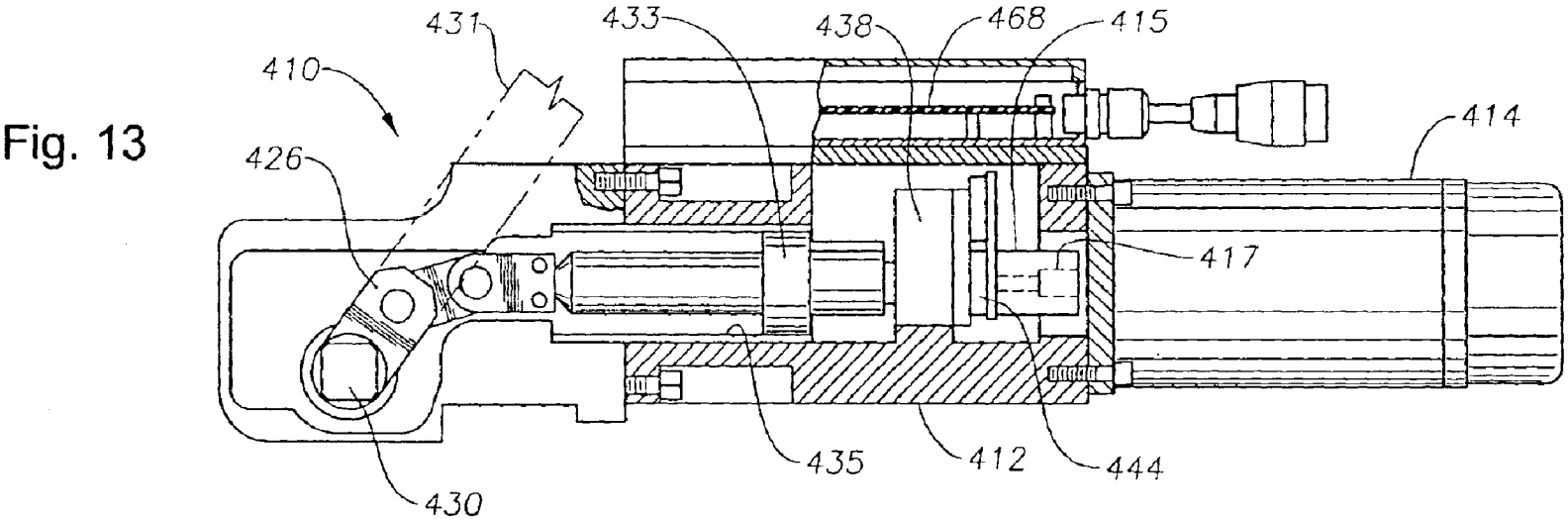
FIG. 13 is a side view of the clamp of FIG. 12, but showing the clamp in its unclamped position.

Referring now to FIGS. 12 and 13, a fourth embodiment of the present invention is depicted as an electric clamp 410. Clamp 410 utilizes many of the components and features of the preceding embodiments, including a housing 412 and an electric motor 414 with a drive shaft 417 that is rotatable about an axis. In the depicted embodiment, motor 414 is mounted to an exterior of the housing 412, and drive shaft 417 protrudes into the housing 412. A helical coupling 415 is mounted to drive shaft 417 and is coupled to a ball nut hub (not shown). A ball screw 424 extends axially through the ball nut hub such that the ball screw 424 is axially advanced and retreated by rotation of the ball nut hub. The ball screw 424 is entirely enclosed within the housing 412. The housing 412 also contains a chamber 435 that is coaxial with the drive shaft 417. A piston 433 is located in the chamber 435, and the piston 433 is coupled to the ball screw 424 such that movement of the ball screw 424 by the electric motor 414 moves the piston 433 axially within the chamber 435.

An output shaft 430 is also mounted to the housing 412. The output shaft 430 has a linkage 426 coupled to the piston 433 for movement therewith, and a mounting portion for a movable element (clamp arm 431) to permit the movable element to at least partially extend from the housing 412, and move the clamp arm 431 between clamped and unclamped positions. As described above for the previous embodiments, clamp 410 also has a control circuit 468 located within an upper portion of the housing 412 for controlling the motor 414, and a sensor 438, such as an encoder, that provides a signal to the control circuit indicative of a current position of the clamp arm 431. The sensor 438 is coupled to the drive shaft 417 via a set of gears 444, and the signal provided to the control circuit is indicative of a rotational position of the drive shaft 417. The clamp 410 further comprises a remote pendant (not shown), which is identical to the one described above.

The present invention offers many advantages over the prior art. Housing the electronics controlling the clamp internally is a significant advantage. Using two motors in tandem is a new and useful arrangement for making a more powerful electric clamp while staying within industry size standards. The remote control provided by the remote pendant is another novel advantage, as is the ability to drive the clamp with power supplied through the remote pendant when normal power is unavailable. The use of an encoder rather than limit switches allows for more intelligent, and more easily modified control. Being able to manually move the clamp using the thumb wheel allows for quick remedy for stuck or defective control condition. The ability to program a clamped and an unclamped position is new and useful, as is the ability to use software to command the clamp to stop when an unrecoverable stuck condition is sensed. The clamp allows for automatic learning of the programmed clamp and unclamped positions, and allows a user to fine tune those positions, if desired.

While the invention has been particularly shown and described with reference to a preferred and alternative embodiments, it will be understood by those skilled in the art that various changes in form and detail may be made therein without departing from the spirit and scope of the invention.

What is claimed is:

1. An electric clamp apparatus, comprising:

a housing;

at least one electric motor mounted to the housing, the at least one electric motor having a motor axis;

a threaded screw entirely enclosed within said housing, wherein the screw has first and second ends and a screw axis extending therebetween, wherein the screw axis is parallel to the motor axis;

coupling means for coupling the screw and said electric motor such that operation of the electric motor translates said screw linearly along said screw axis;

an output shaft coupled to the second end of the screw, wherein the output has a mounting portion for a movable element; and a control circuit for the at least one electric motor, wherein the control circuit is located within the housing and electrically coupled to the at least one electric motor.

2. The electric clamp apparatus of claim 1, and further comprising a bearing within the housing that supports the screw.

3. The electric clamp apparatus of claim 1, wherein the motor axis and the axis of rotation of the screw are coaxial.

4. The electric clamp apparatus of claim 3, wherein said at least one electric motor comprises a linear actuator.

5. The electric clamp apparatus or claim 1, wherein said motor has a motor shaft and wherein said coupling means comprises:

a first sprocket mounted on said motor shaft;

a second sprocket radially spaced apart from the first sprocket;

a drive belt engaging and extending between the first and second sprockets;

a ball nut mounted to the second sprocket for rotation therewith;

wherein the screw extends axially through the ball and such that the screw is advanced and retreated by rotation of the ball nut hub.

6. The electric clamp apparatus of claim 1, wherein said coupling means comprises a helical coupling.

7. The electric clamp apparatus of claim 1, and further comprising a clamp arm mounted to said mounting portion of the output shaft and a linkage coupling the output shaft and the threaded screw.

8. The electric clamp apparatus of claim 1, wherein the housing has an exterior, the electric clamp apparatus further comprising:

at least one input device mounted at the exterior of the housing, where in said at least one input device is coupled to the control circuit to provide an input indication.

9. The electric clamp apparatus of claim 8, wherein the at least one input device comprises at least one manually manipulable switch.

10. The electric clamp apparatus of claim 8, wherein the at least one input device includes a first input device that, when activated, instructs the control circuit to learn a limit position of the output shaft.

11. The electric clamp apparatus of claim 8, wherein the at least one input device includes a position input that, when activated, instructs the control circuit to move the output shaft.

12. The electric clamp apparatus of claim 1, and further comprising a position sensor coupled to said control circuit to provide clamp position feedback to the control circuit.

13. A system comprising:

a plurality of electric clamps in accordance with claim 1; and a central controller electrically coupled to and controlling all of said plurality of electric clamps.

14. An electric clamp apparatus, comprising:

a housing;

at least one electric motor mounted to the housing, wherein the at least one electric motor has a rotor that rotates about a motor axis;

a threaded screw entirely enclosed within said housing, wherein the screw has first and second ends and a screw axis extending therebetween, wherein be screw axis is parallel to the motor axis;

a rotatable element defining a threaded opening through which the threaded screw passes;

a coupling that couples said rotatable element and said at least one electric motor such that rotation of the rotor causes the rotatable element to rotate about the screw axis and linearly displace the screw along the screw axis;

an output shaft coupled to the second end of the screw, wherein the output shaft has a mounting portion for a movable element; and a control circuit for the at least one electric motor, wherein the control circuit is located within the housing and electrically coupled to the at least one electric motor.

15. The electric clamp apparatus of claim 14, and further comprising a bearing within the housing supporting the screw.

16. The electric clamp apparatus of claim 14, wherein the motor axis and the axis of rotation of the screw are coaxial.

17. The electric clamp apparatus of claim 16, wherein said at least one electric motor comprises a linear actuator.

18. The electric clamp apparatus of claim 14, wherein that at least one electric motor has a motor shaft, and wherein said the coupling comprises:

a first sprocket mounted on said motor shaft;

a second sprocket radially spaced apart from the first sprocket and attached to the rotatable element for rotation therewith; and a drive belt engaging and extending between the first and second sprockets, such that the second sprocket and rotatable element are rotated by the drive belt in response to rotation of the first sprocket by the at least one electric motor.

19. The electric clamp apparatus of claim 14, and further comprising a clamp arm mounted to said mounting portion of the output shaft and a linkage coupling the output shaft and the threaded screw.

20. The electric clamp apparatus of claim 14, wherein the housing has an exterior, the electric clamp apparatus further comprising:

at least one input device mounted at the exterior of the housing, wherein said at least one input device is coupled to the control circuit to provide an input indication.

21. The electric clamp apparatus of claim 20, wherein the at least one input device comprises at least one manually manipulable switch.

22. The electric clamp apparatus of claim 20, wherein the at least one input device includes a first input device that, when activated, instructs the control circuit to learn a limit position of the output shaft.

23. The electric clamp apparatus of claim 20, wherein the at least one input device includes a position input that, when activated, instructs the control circuit to move the output shaft.

24. The electric clamp apparatus of claim 14, and further comprising a position sensor coupled to said control circuit to provide clamp position feedback to th control circuit.

25. A system comprising:

a plurality of electric clamps in accordance with claim 14; and a central controller electrically coupled to and controlling all of said plurality of electric clamps.

26. An electric clamp apparatus, comprising:

a housing;

at least one electric motor mounted to the housing, wherein the at least one electric motor has a motor shaft that rotates about a motor axis in response to operation of the at least one electric motor;

a threaded screw entirely enclosed within said housing, wherein the screw has first and second ends and a screw axis extending therebetween, wherein the screw axis is parallel to the motor shaft;

a rotatable element supported within the housing and having threads engaging threads of the threaded screw;

a coupling that couples rotation of the motor shaft to the rotatable element such that operation of the at least one electric motor causes the rotatable element to rotate and linearly displace the screw along the screw axis;

an output shaft coupled to the second end of the screw, wherein the output shaft has a mounting portion for a movable element; and a control circuit for the at least one electric motor, wherein the control circuit is located within the housing and electrically coupled to the at least one electric motor.

27. An electric clamp apparatus, comprising:

a housing;

at least one motor mounted to the housing and having a drive shaft and a drive sprocket coupled to the drive shaft for rotation therewith;

a center sprocket radially spaced apart from the drive sprocket;

a drive belt engaging and extending between the drive sprocket and the center sprocket;

a ball nut mounted to the center sprocket for rotation therewith;

a ball screw extending axially through the ball nut such that the ball screw is advanced and retreated by rotation or the ball nut, wherein the ball screw is entirely enclosed within the housing;

an output shaft and a linkage linking the ball screw to the output shaft, said output shaft having a mounting portion for a clamp arm at least partially external to the housing; and a control circuit located within the housing for controlling the at least one motor.

28. The electric clamp apparatus of claim 27, wherein the at least one motor comprises a pair of electric motors, each having a drive shaft and a drive sprocket, wherein the center sprocket is located between the drive sprockets.

29. The electric clamp apparatus of claim 27, further comprising a clamp arm attached to the output shaft and at least partially external to the housing.

30. The electric clamp apparatus of claim 29, further comprising a sensor that provides a signal to the control circuit indicative of a current position of the clamp arm.

31. The electric clamp apparatus of claim 30, wherein the sensor comprises an encoder and wherein the signal provided to the control circuit is indicative of a rotational position of the drive shaft.

32. An electric clamp apparatus, comprising:

a housing:

an electric motor mounted to the housing;

a lead screw extending axially through the electric motor such that the lead screw is advanced and retreated by the electric motor and the electric motor and the lead screw are coaxial, wherein the lead screw is entirely enclosed within the housing;

an output shaft coupled to the lead screw, said output shaft having a mounting portion for a clamp arm that permits the clamp arm to be at least partially external to the housing; and a control circuit located within the housing for controlling the electric motor.

33. The electric clamp apparatus of claim 32, further comprising a clamp arm attached to the output shaft and a linkage coupling the output shaft and the lead screw.

34. The electric clamp apparatus of claim 33, wherein the linkage further comprises a piston mounted in a chamber within the housing, the piston being coupled to the lead screw and the output shaft, such that movement of the lead screw by the electric motor moves the piston axially within the chamber which moves the output shaft through a range of motion.

35. The electric clamp apparatus of claim 33, further comprising a sensor that provides a signal to the control circuit indicative of a current position of the clamp arm.

36. The electric clamp apparatus of claim 35, wherein the sensor comprises an encoder and wherein the signal provided to the control circuit is indicative of a rotational position of the electric motor.

37. The electric clamp apparatus of claim 36, further comprising:

one or more electrical switches mounted on the housing that actuate the motor to drive the output shaft toward at least one of a clamped position and an unclamped position.

38. An electric clamp apparatus, comprising:

a housing;

an electric motor mounted to the housing and having a drive shaft with an axis;

a ball nut hub coupled to the drive shaft for rotation therewith;

a ball screw extending axially through the ball nut hub such that the ball screw is advanced and retreated by rotation of the ball nut hub, wherein the ball screw is entirely enclosed within the housing;

a chamber located in the housing and coaxial with the ball screw;

a piston located in the chamber, the piston being coupled to the ball screw such that movement of the ball screw by the electric motor moves the piston axially within the chamber;

an output shaft having a linkage coupled to the piston for movement therewith, and a mounting portion for a movable element to permit the movable element to be at least partially external to the housing; and a control circuit located within the housing for controlling the at least one motor.

39. The electric clamp apparatus of claim 38, further comprising a clamp arm attached to the output shaft.

40. The electric clamp apparatus of claim 39, further comprising a sensor that provides a signal to the control circuit indicative of a current position of the clamp arm.

41. The electric clamp apparatus of claim 40, wherein the sensor comprises an encoder coupled to the drive shaft via a set of gears, and wherein the signal provided to the control circuit is indicative of a rotational position of the drive shaft.

* * * * *

UNITED STATES PATENT AND TRADEMARK OFFICE

CERTIFICATE OF CORRECTION

PATENT NO. : 6,883,795 B2
APPLICATION NO. : 10/640200
DATED : April 26, 2005
INVENTOR(S) : McCormick et al.

It is certified that error appears in the above-identified patent and that said Letters Patent is hereby corrected as shown below:

In Claim 1, at column 7, line 38, after "output" and before "has" insert --shaft--.

In Claim 5, at column 7, line 60, delete "and" and insert --nut--.

In Claim 8, at column 8, line 7, delete "where" and delete "in" and insert --wherein--.

In Claim 24, at column 9, line 28, delete "th" and insert --the--.

In Claim 27, at column 10, line 3, delete "or" and insert --of--.

Signed and Sealed this

Twenty-second Day of August, 2006

JON W. DUDAS
*Director of the United States Patent and Trademark Office*